US006039791A

United States Patent [19]

Kazeef et al.

[11] Patent Number: 6,039,791

[45] Date of Patent: Mar. 21, 2000

[54] FUSED CALCINED PETROLEUM COKE AND METHOD OF FORMATION

[76] Inventors: Michael G. Kazeef, 2000 Santiago Dr., Newport Beach, Calif. 92660; Raymond Perruchoud, 3867 Vercorin, Roches-Hombes 5, Switzerland

[21] Appl. No.: 08/956,543

[22] Filed: Oct. 23, 1997

[51] Int. Cl.[7] ..... C22B 1/14; C10G 9/00

[52] U.S. Cl. ..... 75/764; 75/766; 208/131; 201/25

[58] Field of Search ..... 208/131; 75/764, 75/766; 201/25

[56] References Cited

U.S. PATENT DOCUMENTS 3,853,793 12/1974 Brown et al. ..... 252/510
4,039,319 8/1977 Schapiro et al. ..... 75/42
4,534,949 8/1985 Glaser et al. ..... 423/445
5,490,918 2/1996 Meek ..... 208/131

*Primary Examiner*—Bekir L. Yildirim
*Attorney, Agent, or Firm*—Jones & Askew, LLP

[57] ABSTRACT

Certain physical properties, chemical composition and a content of volatile carbonaceous materials define the limits of the use of coke by-products of crude oil refining as green cokes for use in the manufacture of calcined cokes suitable in the production of anodes for the reduction processes in the aluminum industry. These limits render large quantities of green coke unusable for the purpose set forth above. The invention shows a way to overcome these limits by rendering up to now unusable cokes usable as green cokes for the manufacture of calcined cokes for the production of anodes.

18 Claims, 1 Drawing Sheet

FUSED CALCINED PETROLEUM COKE AND METHOD OF FORMATION

TECHNICAL FIELD

The present invention generally relates to the production of anode grade cokes. More specifically, the present invention includes a process for the production of a fused calcined petroleum coke from a fuel grade green coke or a mixture of fuel grade and green cokes that have heretofore been considered to be unsuitable for calcination and use as anode grade coke.

BACKGROUND OF THE INVENTION

The feedstock to produce calcined petroleum coke is called green coke. There are many different qualities of green coke produced throughout the world. Such green coke is a byproduct of the refining of crude oil.

Calcined petroleum coke has to meet specific quality requirements to be usable in the aluminum industry, especially for the manufacture and consumption of anodes in the reduction process. The green coke feedstock has to meet quality requirements that will result in the desired quality requirements of the final calcined coke product (anode grade coke). Therefore, not all green cokes will be suitable for the production of anode grade coke.

The most important and also widely recognized quality requirements for anode grade coke are vibrated bulk density, real density, grain stability and impurities especially metallic (listed below). Metallic impurities have a negative impact on the purity of the metal (aluminum) produced with the anodes and also on the production cost through their strong catalytic influence on the consumption of carbon needed to produce a given quality of aluminum. Calcination of green coke does not change some key quality parameters, especially the chemical elements. Some green cokes meet the quality requirements and are used to make anode grade coke. These green cokes are called "anode grade green cokes". Some green cokes will not meet the quality requirements and are used in basic applications, including but not limited to fuel in power plants. Green cokes which make up the majority of the production throughout the world are called fuel grade green cokes and are typically not calcined.

Time and technological experience have established practical limits to distinguish what is and what is not an anode grade green coke. More than 11% weight maximum of volatile matter in a green coke renders that coke unsuitable for the current state of the established calcining technology. More than 30% of the grains with a grain size greater than 4 mm makes it suitable. Less than 35% of the grains with a grain size smaller than 1 mm makes it suitable. Less than 3.5% sulfur content in the final calcined coke makes it suitable to comply with most of the current environmental regulations and less than 400 ppm vanadium in the final calcined coke makes it suitable. The above identified limits are not scientifically defined limits; they are however the accepted borders of the trade. In addition, the other quality requirements for anode grade coke (vibrated density, real density, grain stability) have an impact on which sources of green coke can be used. Commercially acceptable anode grade green cokes have the following properties:

| Property | Accepted Range |
|---|---|
| Sulphur (%) | 0.5–3.5 |
| Vanadium (ppm) | 30–400 |
| Nickel (ppm) | 40–300 |

-continued

| Property | Accepted Range |
|---|---|
| Tapped bulk density (kg/dm$^3$) (1 to 2 mm grain size) | 0.76–0.88 |
| Real density (kg/dm$^3$) | 1.95–2.10 |
| Grain stability (%) (8 – 4 mm) | 60–95 |

Many green cokes are not usable when they cannot provide one or several of the quality characteristics noted above required to classify the resulting calcined cokes as anode grade coke. The chemical composition and other characteristics can disqualify a green coke or a mixture of green cokes from being candidates for feedstock. The inability of some green cokes to sustain the calcining conditions can also be another major reason for disqualifying such green cokes from being candidates for feedstock. It is related to the rotary kiln calcining processes used almost exclusively throughout the world. This process is referred to as dynamic calcination.

Calcination of a green coke is the operation of applying high temperature (typically up to 1350° C.) to drive out the amount of hydrocarbon volatiles remaining in the green coke and to increase the density of the carbon material. Calcination is a necessary step in the process of making anode grade coke. The dynamic calcination process relates to a situation where the green coke physically moves through a calcining device such as a rotary kiln or a rotary hearth. It enters the calciner as green coke and exits a short time later as calcined coke. In the calcining conditions that prevail in such equipment, even some green cokes that would have all the favorable characteristics to be converted into anode grade coke are not usable. The reason for this situation comes from the green coke behavior during the dynamic calcination processes that are used in the trade throughout the world. The temperature gradient in these calciners is high, up to 200° C. per minute. Beyond a certain content of volatiles remaining in the green coke the coke resulting from calcination is porous, of light density. This calcined coke is referred to as "popcorn" and it is unusable for the manufacture of anodes. Consequently, otherwise very acceptable green cokes end up being used as fuel grade cokes, due to their high volatile levels, which means volatile levels in excess of 11% by weight.

Green coke is a bottom end low value by-product of the refining of crude oil. Coke chemical properties come from the original crude oil requiring the blending of various quality green cokes to obtain a green coke of average quality. Acceptable quality green cokes usable by themselves are diminishing. This is a result of the use of more sour crude oils with higher sulfur and metallic contents. The "slate of crudes" used is dictated by refinery economics rather than by quality concerns of the by-products. As stated above, this situation leads to shortages of green cokes that meet the quality requirements and environmental mandates pertaining to various coke applications.

In order to minimize this impact, it is the objective of the invention to provide a process for transforming a feedstock of green cokes, hereto generally used in the fuel grade market, into calcined coke of acceptable anode grade quality.

SUMMARY OF THE INVENTION

The foregoing objective is achieved by the invention of a process which uses the very factors and characteristics of green cokes which typically disqualify them from being used as feedstock for the production of anode grade coke. The invention includes the creation of a new product with its own characteristics that are different from each of the green cokes used to produce it. Thus, it is to be understood that the invention includes the ability to reclaim certain green cokes that have been previously considered as unacceptable for calcination. In accordance with the present invention, such typically unacceptable fuel grade green cokes are processed or engineered to form a new fused coke product suitable for the production of anodes.

A blend of green cokes can be used in various proportions, up to and including 100% of a single green coke, to meet required chemical and/or physical characteristics. Further, a blend can be engineered to bring special characteristics or properties to that blend which will foster the creation of the new product during the calcination process. For example, instead of looking for and choosing a feedstock that does not exceed the acceptable limit of about 11% by weight of volatiles, the invention is capable of processing green cokes that have a higher volatile content. The other necessary chemical characteristics are assumed to be satisfied, for instance, by way of blending.

The inventors have found that higher volatiles in adequate quantities provide the bond during calcination for fusion of all the green coke(s) present individually or in the blend, provided however, the popcorn effect does not occur. This is accomplished by application of a static calcination process. In one embodiment of the invention, the calcination may take place statically, i.e., the load of green cokes(s) would not move but remain static during the entire process of driving out the volatiles. The calcining process used in the invention is preferably a batch process, although one of ordinary skill will appreciate that the invention is applicable to other processes. The green coke is placed into the calciner at ambient temperature and taken out at a high temperature to be cooled down rapidly. The process may take place in an environment where the temperature gradient is 200° C. per hour plus or minus 10° C. As a result of the slow heating, the time allowed to drive the volatiles from the green coke is much longer, thereby avoiding the result of porous popcorn-like material. Further, the process, according to the invention, uniquely allows, if so desired, customization of the process parameters of each load to be calcined, thus providing the ability to further expand the reach of the invention to include a broader range of feedstock materials.

A preferred embodiment of the invention provides the use of typically unsuitable feedstock materials having volatile contents (volatile contents higher than 11% by weight) to be converted or transformed such that the whole mass of carbon material goes through a fusion and complete transformation. A new product emerges satisfying the requirements for the production of carbon anodes. The new product of the invention has its own characteristics, namely crystalline structure, density and grain size which can be customized or engineered for specific purposes. Each of these characteristics is new and has no link to the structure or physical properties of the feedstock material(s). The only link is that the resulting chemical composition of the new fused anode grade coke is the weighted average of the chemical properties of the feedstock material(s). Unlike blends of calcined cokes which are heterogeneous and carry with them the advantages and drawbacks of each of their constituents, the new product is homogeneous. It has a homogeneous structure, uniform physical properties and chemical composition. The new product is not a blend. It has its own identity and properties.

The invention provides the ability to utilize a mix of feedstock materials having differing amounts of volatiles and possessing differing parameters for static calcining. In this way, the invention opens up the potential for recovering and converting large amounts of green cokes, heretofore generally used only as fuel grade green cokes or that have otherwise been considered waste material, into an anode grade coke.

BRIEF DESCRIPTION OF THE DRAWING

Additional advantages, features and details of the invention become apparent from the following description of the preferred embodiments when used in conjunction with the accompanying drawing reflecting one such embodiment of the invention.

DETAILED DESCRIPTION

Figure 1:
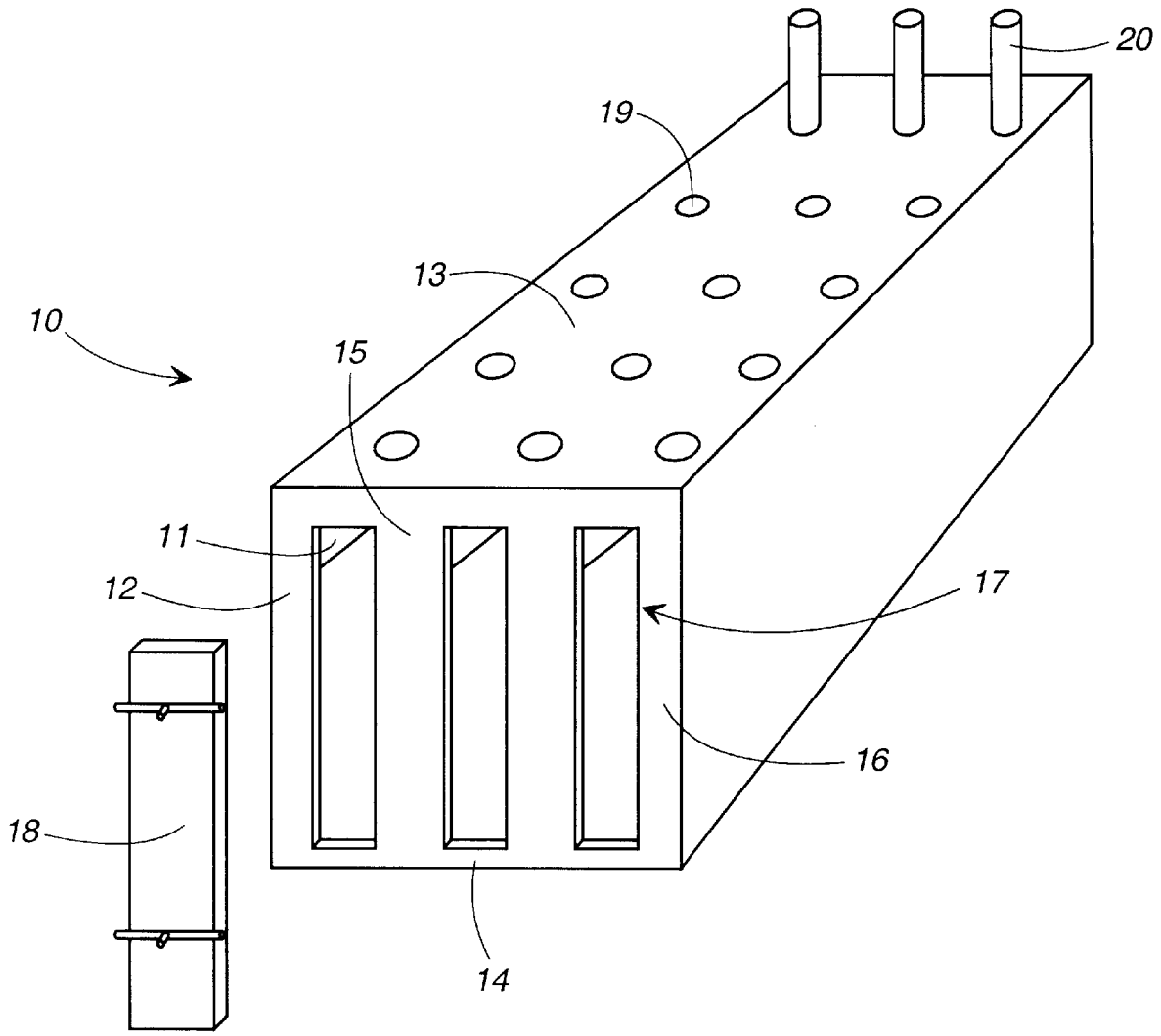
FIG. 1 is a diagrammatic perspective view of an apparatus for carrying out a process according to the invention.

Referring to FIG. 1, an apparatus for the static calcination of green petroleum coke or green petroleum coke mixtures (also referred to as calcining material) includes a chamber furnace 10 having at least one chamber 11 which is charged with the calcining material 12. The chambers 11 are formed by a top plate 13, a bottom plate 14 and two end walls 15 and by web portions 16. The chambers 11 in the end walls 15 (front and rear) are of an open configuration (openings 17) so that the chambers 11 which extend horizontally in their longitudinal extent can be discharged by way of openings 17. During the calcination operation the openings 17 are closed by means of covers 18 to seal the chambers from ambient air environment. The chambers 11 are charged by way of charging openings 19 which are provided in the top plate 13 and which are closable. Disposed at one end of each chamber 11, that is to say towards an end wall 15, is a discharge 20 by way of which gaseous constituents are driven out of the calcining material 12 during the calcination operation are discharged from the chambers 11 which chambers 11 are air-tight and sealed during that procedure. The walls of the chamber furnace 10, preferably the two web portions 16, are so heatable that any temperature between 1000° C. and 1400° C., preferably between 1150° C. and 1250° C., can be generated therein and which temperatures can thereafter permanently prevail within each chamber 11.

A chamber furnace 10 was outlined hereinbefore in terms of its parts which are advantageous for the execution of the invention. The execution of the invention is not restricted to the described chamber furnace 10. A shaft furnace would be equally suitable to carry out the process according to the invention.

Described hereinafter is the process of the invention for converting or processing a quantity of green coke to give a calcined petroleum coke which is suitable for anode production (referred to as anode grade coke). The process is divided into the following three steps:

(a) green coke preparation (b) calcination, and (c) calcinate preparation.

In the green coke preparation procedure, green cokes are selected according to their chemical composition and volatile content and in such quantities so that after mixing, the coke mix will show a chemical composition having the weighted average of the chemical properties of the selected individual green cokes, the chemical composition of which satisfies the established chemical quality requirements, and further has a volatile content sufficiently high (above 11% by weight) to assure formation of a new product during the calcination. The selected green cokes are crushed individually or as a mix of the given green cokes with a granulometry of 75% to 85%, preferably 78% to 81% of the coke grains of a size of less than 2 mm while the respective residual amount is crushed to a size of from 2 mm to 4 mm. This granulometry of an individual green coke or a blend of green cokes was found to be advantageous for the calcination process and formation of the new product. If the green cokes are crushed individually, the mixing is effected after the crushing operation, in which case the desired composition of a mix is adjusted from the crushed individual green cokes. However, the mixture can also be adjusted prior to the crushing operation.

The operation of selecting, mixing and reducing the size of the product, that is to say crushing it or breaking it with previous or subsequent mixing of the product, defines the green coke preparation step in the process.

Chambers 11 of the described chamber furnace 10 are filled with the mix material, also referred to hereinafter as the calcining material. The filling operation is effected with the openings 17 closed, by way of the charging openings 19 which are closed after the charging operation is concluded so that the chambers 11 are sealed and airtight. The chambers 11 are heated to a temperature of between 1000° C. and 1400° C., preferably 1150° C. and 1250° C. The material 12 is heated to a final temperature of between 1000° C. and 1200° C. and the coke components, volatilized in that operation are discharged by way of the discharges 20. The residence time of the calcining material 12 in the chambers 11 (calcination period) is between 18 and 34 hours, preferably between 23 hours and 25 hours. It is essential that the core of the calcining material reaches a temperature of at least 1000° C. and is held at that temperature for a period of between 3.5 hours to 5.5 hours, preferably between 3.8 and 4.0 hours. During the residence time period, starting from the heated chamber walls, in the present case the web portions 16, that is to say from the surface of the calcining material 12 at which it is in contact with the inner heated wall surfaces of the web portions 16, towards the center, that is to say the core of the calcining material 12, the calcining material 12 is progressively heated up with a low temperature gradient of between 120° C. and 240° C., preferably between 190° C. and 210° C. per hour, to the indicated final temperature. During the calcination operation the grains of the calcining material 12 form the new product in the form of agglomerates with grains in the order magnitude of between 50 mm and 100 mm. Calcination parameters (chamber temperatures, calcination period, temperature gradient, holding time for the core of the calcining material) are variable in order to customize the calcination parameters of each load of coke(s) as desired or necessary. To simplify the chamber emptying procedure, the agglomerate or the calcined chamber filling should shrink as a body, more specifically with an order of magnitude of about 1%. Thus, it is contemplated that a good degree of calcination is attained. A calcinate with a good degree of calcination is one with an awarded real density of greater than 1.95 kg/dm$^3$ and lower than 2.10 kg/dm$^3$. Such parameters are variable within the above-stated ranges. In principle, the expiration of the holding time coincides with the expiration of the calcination period, that is to say the residence time of the calcining material 12 in chambers 11. After expiration of the calcination period, the hot calcinate is pushed from the chambers 11 and cooled with water (wet cooling) or in an inert atmosphere (dry cooling). In the case of wet cooling the calcinate is exposed to the action of the cooling water only until the calcinate has absorbed at most 5% of its weight in water.

The procedures of heating the green coke(s) under the exclusion of air, driving out the volatile carbonaceous materials (VCM) therein, forming therewith a new product as calcinate, being a fused anode grade coke, pushing same from the calciner, and cooling the calcinate broadly outline the calcination step.

Subsequent to the cooling operation the calcinate, in the form of relatively large-size agglomerates, is crushed or ground into a grain size typical for the production of anodes (typical grain size: minimum 30% of the grains larger than 4 mm, maximum size of the grains 25 mm). Thereafter, in case wet cooling is applied, a drying operation is effected for the prepared calcinate in order to reduce the water content of the grains to an amount of less than 0.3%. Once again, such parameters are variable within the above-stated ranges.

Cooling the calcinate preparation by crushing or grinding and drying of the calcinate prepared in the above manner represent the process step referred to as calcinate preparation.

The described process according to the invention and the described apparatus for carrying out the process may be involved in processing the cokes in accordance with the Examples 1 to 5 (Examples 1 and 5 individual green cokes, Examples 2, 3 and 4 green coke mixtures in a 1:1 mixing ratio in respect of the green coke component, the 1:1 mixing ratio is selected by way of example. It could also be any other ratio which in the calcinate results in the desired specifications), the specifications thereof being summarized in Table I.

EXAMPLE 1

An individual green coke of the fuel grade coke classification having a VCM-content which exceeds 11% and the properties listed in Table I was processed. The green coke was heated in the chamber at a temperature gradient of 180° C./hr to a final temperature of 1260° C. where it was held for 24 hours. The core of the material reached a temperature of 1150° C. and was maintained at that temperature for 5 hours. The calcinate of the individual green coke is suitable for anode production (anode grade coke).

EXAMPLE 2

This Example involved processing a green coke mixture comprised of the individual green coke A (10,000 kg) and the individual green coke B (10,000 kg). Coke A and coke B were fuel grade green cokes having the properties listed in Table I. The green coke was heated in the chamber at a temperature gradient at 210° C./hr to a final temperature of 1250° C. where it was held for 23 hours. The core of the material reached a temperature of 1140° C. and was maintained at that temperature for 4 hours. The calcinate resulting from this mixture falls within the quality identification of anode grade coke.

EXAMPLE 3

This Example involved processing a green coke mixture comprised of the individual green coke C (10,000 kg) and the individual green coke D (10,000 kg). Coke C was a fuel grade green coke and coke D was an anode grade green coke. The green coke was heated in the chamber at a temperature gradient of 200° C./hr to a final temperature of 1240° C. where it was held for 26 hours. The core of the material reached a temperature of 1160° C. and was maintained at that temperature for 5 hours. The calcinate of the mixture falls within the quality identification for anode grade coke.

EXAMPLE 4

This Example involved processing a green coke mixture comprised of the individual green coke E (10,000 kg) and the individual green coke F (10,000 kg). Coke E was a fuel green grade coke and the coke F was an anode grade green coke. The green coke was heated in the chamber at a temperature gradient of 210° C./hr to a final temperature of 1260° C. where it was held for 23 hours. The core of the material reached a temperature of 1140° C. and was maintained at that temperature for 4 hours. The calcinate of the mixture falls within the quality identification for anode grade coke.

EXAMPLE 5

This Example involved processing an individual green coke of the fuel grade coke classification. The green coke was heated in the chamber at a temperature gradient of 190° C./hr to a final temperature of 1240° C. where it was held for 24 hours. The core of the material reached a temperature of 1160° C. and was maintained at that temperature for 5 hours. The calcinate of the individual green coke falls within the quality identification for anode grade coke.

TABLE I

| | Examples | | | | | | | |
|---|---|---|---|---|---|---|---|---|
| | 1 | 2 | | 3 | | 4 | | 5 |
| FEED COKE PROPERTIES | | A | B | C | D | E | F | |
| Volatile constituents % | 15.6 | 14.7 | 16.4 | 16.0 | 9.9 | 14.3 | 10.3 | 14.5 |
| Sizing + 8 mm % | 35 | 28 | 25 | 36 | 30 | 47 | 33 | 4 |
| −1 mm % | 19 | 31 | 32 | 22 | 25 | 23 | 26 | 55 |
| Sulphur % | 1.8 | 5.5 | 0.4 | 1.7 | 3.6 | 1.8 | 3.0 | 0.5 |
| Vanadium ppm | 80 | 560 | 50 | 70 | 222 | 500 | 120 | 50 |
| Nickel ppm | 150 | 330 | 50 | 150 | 113 | 270 | 70 | 50 |
| CALCINED COKE PROPERTIES | | A + B | | C + D | | E + F | | |
| Tapped bulk density (1–2 mm) | 0.82 | 0.84 | | 0.87 | | 0.82 kg/dm$^3$ | | 0.82 |
| Real density | 2.04 | 2.04 | | 2.03 | | 2.03 kg/dm$^3$ | | 2.03 |
| Grain stability (8–4 mm) | 94 | 79 | | 89 | | 86% | | 85 |
| Sulphur % | 1.7 | 3.1 | | 2.5 | | 2.3% | | 0.5 |
| Vanadium ppm | 90 | 340 | | 180 | | 340 | | 60 |
| Nickel ppm | 160 | 210 | | 140 | | 180 | | 60 |

It is to be understood that the invention is not limited to the illustrations described and shown herein. Such examples are deemed to be merely illustrative of the best modes of carrying out the invention and are susceptible to modification of form, size, arrangement of parts and details of operation. Rather, the invention is intended to encompass all such modifications which are within its spirit and scope as defined by the claims.

What is claimed is:

1. A process for the production of anode grade coke comprised of the following steps:

(a) providing at least one granular green coke material to be calcined, said granular green coke material having a volatile carbonaceous materials content of greater than or equal to 16% by weight;

(b) positioning said at least one green coke material in a furnace; and (c) heating said at least one green coke material in the furnace in the absence of air, under static conditions and controlled temperature and time, so as to reduce the volatile carbonaceous materials content and agglomerate of said granular green coke material to an anode grade homogeneous coke product having a Real density (kg/dm3) within an accepted range of 1.95–2.10 and a grain stability (%) (8–4 mm) of 60–95.

2. A process according to claim 1 which includes the step of heating said at least one granular green coke material to a temperature of between approximately 1000° C. to 1200° C.

3. A process according to claim 2 which includes the step of heating said at least one granular green coke material to temperature at a temperature gradient of between approximately 120° C. per hour to approximately 240° C. per hour.

4. A process according to claim 2 which includes the step of heating said at least one granular green coke material to temperature at a temperature gradient of between approximately 190° C. per hour to approximately 210° C. per hour.

5. A process according to claim 2 which includes the step of heating said at least one granular green coke material for a time period of between approximately 18 hours to approximately 34 hours.

6. A process according to claim 2 which includes the step of heating said at least one granular green coke material for a time period of between approximately 23 hours to approximately 25 hours.

7. A process according to claim 1 which includes the steps of heating said at least one green coke material wherein the core of the material reaches a temperature of between approximately 1000° C. to approximately 1200° C. and thereafter maintaining said at least one green coke material at said temperature for a period of between approximately 3.5 hours to approximately 5.5 hours.

8. A process according to claim 1 which includes the steps of heating said at least one green coke material wherein the core of the material reaches a temperature of between approximately 1000° C. to 1200° C. and thereafter maintaining said at least one green coke material at said temperature for a period of between approximately 3.8 hours to approximately 4.0 hours.

9. A process according to claim 1 which includes the step of processing said at least one granular green coke material prior to heating in order to obtain green coke material wherein between approximately 75 to approximately 85% wt. of the green coke material has a grain size of less than or equal to 2 mm.

10. A process according to claim 1 which includes the step of processing said at least one granular green coke material prior to heating in order to obtain a green coke material wherein between approximately 78 to approximately 81% wt. of the green coke material has a grain size of less than or equal to 2 mm.

11. A process according to claim 9 wherein substantially all of the residual product has a grain size of between approximately 2 mm to approximately 4 mm.

12. A process according to claim 1 wherein said granular green coke material is agglomerated in step (c) so as to form grains of a size of between approximately 50 mm to approximately 100 mm.

13. A process according to claim 12 including the step of processing said agglomerated anode grade coke product so as to form an anode grade coke product wherein between 30 to 40% wt. of the product has a grain size of greater than or equal to 4 mm with a maximum grain size of 25 mm.

14. A process according to claim 1 which includes the step of providing a chamber furnace.

15. A process according to claim 1 which includes the step of providing a shaft furnace.

16. A process according to claim 3 which includes the steps of heating said at least one granular coke material wherein the core of the material reaches a temperature of at least approximately 1000° C. and thereafter holding the temperature for a period of between approximately 3.5 to approximately 5.5 hours.

17. A process according to claim 1 which includes the steps of providing a plurality of granular green coke materials and selectively mixing said granular green coke materials in amounts to produce an anode grade coke product having the following properties:

| Property | Accepted Range |
|---|---|
| Sulphur (%) | 0.5–3.5 |
| Vanadium (ppm) | 30–400 |
| Nickel (ppm) | 40–300 |
| Tapped bulk density ($kg/dm^3$) (1 to 2 mm grain size) | 0.76–0.88 |
| Real density ($kg/dm^3$) | 1.95–2.10 |
| Grain stability (%) (8 – 4 mm). | 60–95 |

18. Coke formed from a process comprised of the following steps of:

(a) providing at least one granular green coke material to be calcined, said granular green coke material having a volatile carbonaceous materials content of greater than or equal to 16% by weight;

(b) positioning said at least one green coke material in a furnace;

(c) heating said at least one green coke material in the furnace in the absence of air under static conditions and controlled temperature and time so as to reduce the volatile carbonaceous materials content and agglomerate said granular green coke material to an anode grade coke product having a Real density (kg/dm3) within an accepted range of 1.95–2.10 and a grain stability (%) (8–4 mm) of 60–95.

* * * * *